US005930978A

United States Patent [19]

Kim

[11] Patent Number: 5,930,978

[45] Date of Patent: Aug. 3, 1999

[54] APPARATUS FOR PACKING PRODUCTS AND METHOD FOR CONTROLLING THE SAME

[75] Inventor: Il-Soo Kim, Seoul, Rep. of Korea

[73] Assignee: SamSung Electronics Co., Ltd, Kyungki-do, Rep. of Korea

[21] Appl. No.: 09/059,395

[22] Filed: Apr. 14, 1998

[30] Foreign Application Priority Data

Apr. 15, 1997 [KR] Rep. of Korea ..... 97-13867

[51] Int. Cl.[6] ..... B65B 67/00

[52] U.S. Cl. ..... 53/390; 53/493; 53/55; 53/58; 53/241

[58] Field of Search ..... 53/536, 241, 255, 53/392, 391, 390, 52, 55, 58, 493

[56] References Cited

U.S. PATENT DOCUMENTS

| | | | |
|---|---|---|---|
| 822,956 | 6/1906 | Kelly . | |
| 2,652,180 | 9/1953 | Fox | 226/16 |
| 2,911,775 | 11/1959 | Schwebs | 53/37 |
| 2,921,702 | 1/1960 | Gross | 214/310 |
| 3,583,588 | 6/1971 | Royal, Sr. | 214/713 |
| 4,143,503 | 3/1979 | Anderson et al. | 53/228 |
| 4,226,568 | 10/1980 | Christian | 414/589 |
| 4,693,370 | 9/1987 | Aceti | 206/488 |
| 4,707,970 | 11/1987 | Labombarde et al. | 53/529 |
| 4,785,611 | 11/1988 | Hasenbalg | 53/536 |
| 4,796,407 | 1/1989 | Sun | 53/390 |
| 5,473,861 | 12/1995 | Fukunaga et al. | 53/441 |
| 5,743,067 | 4/1998 | Trimani | 53/151 |

*Primary Examiner*—Joseph J. Hail, III
*Assistant Examiner*—William Hong
*Attorney, Agent, or Firm*—Robert E. Bushnell, Esq.

[57] ABSTRACT

A product such as a monitor is transferred by a transferring unit such as a conveyor, stopped at a working position, elevated to a packing position by an elevating unit, packed with packing material, such as with a vinyl cover, buffering materials and a box at the packing position, moved down to its original down position, and transferred to a subsequent process in the fabricating or process line. In addition, a cylinder is used for elevating the product to permit packing the product. A plurality of supporting bars are fixed to an elevating member installed at an end of a cylinder rod of the cylinder. Only the product, such as a monitor, loaded on a transferring member, such as a pallet, is moved up by the engaging operation of the supporting bars. For slidable insertion of the supporting bars, a plurality of insertion holes corresponding to the supporting bars are formed in the transferring member.

20 Claims, 6 Drawing Sheets

APPARATUS FOR PACKING PRODUCTS AND METHOD FOR CONTROLLING THE SAME

CLAIM OF PRIORITY

This application makes reference to, incorporates the same herein, and claims all benefits accruing under 35 U.S.C. §119 from an application for APPARATUS FOR PACKING PRODUCTS AND METHOD FOR CONTROLLING THE SAME earlier filed in the Korean Industrial Property Office on the 15th of Apr. 1997 and there duly assigned Ser. No. 13867/1997.

BACKGROUND OF THE INVENTION

1. Field of the Invention

The present invention relates to an apparatus for packing products such as a computer monitor, a television, a washing machine, a dehydrating machine and so on, with buffering materials mounted thereon and a method for controlling the packing apparatus. More particularly, it relates to a method for easily changing a working position and a packing position of products that are completely fabricated through a fabricating process, to thereby more conveniently pack the products and control the packing apparatus.

2. Description of the Related Art

Generally, a great number of parts are fabricated and formed as products through a fabricating line, i.e., a fabricating system in which processes or steps of a packing process are performed in order. The fabricating line provides specialized processes for mass production.

For example, U.S. Pat. No. 4,143,503 to Anderson et al., entitled Flat Turret Transporting Mechanism, disclose a flat turret transporting mechanism for transporting an article. The apparatus includes a conveyor and a means for driving the conveyor synchronously and intermittently at least two driving positions along a path having a plurality of work stations. The apparatus will intermittently move the article from one work station to another with the conveyor being substantially completely driven without any drive function being associated therewith. Also, a vertical adjustment of the transporting mechanism with respect to a moving package to be wrapped in conjunction with a wrapping machine is disclosed.

Further, U.S. Pat. No. 4,226,568 to Christian, entitled Pallet Positioner, discloses a pallet positioner used to locate a pair of pallets in selected positions on a turntable of a concrete pipe making machine. The pallet positioner has a frame supported for vertical movement on upright supports below the turntable. A hydraulic cylinder is disclosed as being connected to the frame operates to move the frame up and down, with a pallet guide and positioning structure connected to the frame being moved up through holes in the turntable to support pallets above the turntable.

Additionally, U.S. Pat. No. 5,473,861 to Fukunaga et al., entitled Packing Method And Packing Apparatus, discloses a packing method and packing apparatus, wherein a substance to be packed is carried from a carrying-in section in which the substance is carried to a position under a packing section where a film stands by in a horizontally stretched stated. The substance to be packed is lifted to the film and is covered on the upper surface with the film, and the end portions of the film are folded under the bottom portion of the substance to be packed. The packing method and packing apparatus of Fukunaga et al. are for a no-tray system for directly packing a substance to be packed without a tray. In Fukunaga et al., an article is carried in and placed on a carrying-in section and is received on a carrying base, and the carrying base is moved to a packing section where a film is drawn and stretched, to carry the substance to be packed to the packing section.

Some of the processes on the fabricating line are numerically controlled by robots, some of them are performed by apparatuses including cylinders, motors, or solenoids, and some of them are manually performed. In general, such as for relatively larger articles, product packing processes are manually performed. However, the manually performed packing process suffers from several disadvantages.

Typically, products are packed by operators as follows. First the product is covered with a vinyl cover, with two or four pieces of buffering materials being mounted on the comer portions of the product covered with the vinyl cover. Then, the product with the vinyl cover and the buffering materials is packed with or in a box.

At this time, the product is loaded on a pallet that is a moving member of a conveyor. In order to cover the product with the vinyl cover and in order to mount the buffering materials on the comer portions of the product, the operator typically has to tilt the product forward and behind, and right and left. This is very cumbersome and time consuming work. Moreover, some products are so large and heavy that the operator cannot do the packing job alone, requiring the packing job to be generally performed by two operators. This generally causes loss of labor efficiency and can result in reduced process efficiency and increased cost.

Moreover, in the event that the product is too large and heavy to be lifted by the operator, the product typically is displaced or removed from the fabricating line and packed by separately installed packing equipment. This also results in increased cost.

SUMMARY OF THE INVENTION

The present invention overcomes the above described disadvantages of the conventional art. It is therefore an object of the present invention to more conveniently and efficiently pack products on a fabricating line using an elevating unit.

According to the present invention, a product, such as a monitor for use with a computer, to be packed (e.g., a monitor) is loaded on a transferring member or loader, such as a pallet, and transferred to a working position together with the loader by a transferring unit. When the product loaded on the loader or pallet is located at the working position, the product is moved up from an original position to a packing position using an elevating unit. After completion of packing of the product, the product is moved down to the original position.

According to the present invention, an elevating unit, such as a cylinder having elevating power, is used to move up or raise the monitor or product to be packed. A plurality of supporting bars are fixed to the elevating member and installed at an end of the elevating member, such as at an end of a cylinder rod of the cylinder. The supporting bars are slidably inserted into insertion holes formed in the transferring member. When the supporting bars are slid up through the insertion holes of the transferring member, only the product to be packed (e.g., a monitor) loaded on the transferring member is raised or moved up to the packing position.

In addition, according to the present invention, a limit switch as a sensor is used to sense whether the transferring member arrives at the working position or not. According to a signal outputted from the limit switch, a controller operates front and rear stoppers to hold the transferring member and operates the cylinder for elevating the monitor to the packing position. When the packing job is completed, the operator operates a foot switch to make the controller lower the elevating member of the elevating unit and operate or move the transferring unit, such as a conveyor system.

The present invention also provides a pallet for use in an apparatus for packing products, such as may be used in a conveyor system. The pallet includes a base portion and a recessed portion for receiving the product to be packed. One or more insertion holes through the base portion within the recessed portion are provided for slidable insertion of corresponding one or more supporting bars for engaging the product to be packed during raising and lowering of the product to and from an original position and a packing position at a working position of the apparatus.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those having skill in the art.

An embodiment of a packing apparatus according to the present invention will be described by means of examples of a conveyor system as a transferring unit, a computer monitor as a product to be packed and a cylinder as an elevating force generating member. Particularly, the packing apparatus according to the present invention will be described by means of an example, whereby the computer monitor is loaded on a pallet and transferred along a conveyor frame of the conveyor system.

Figure 1:
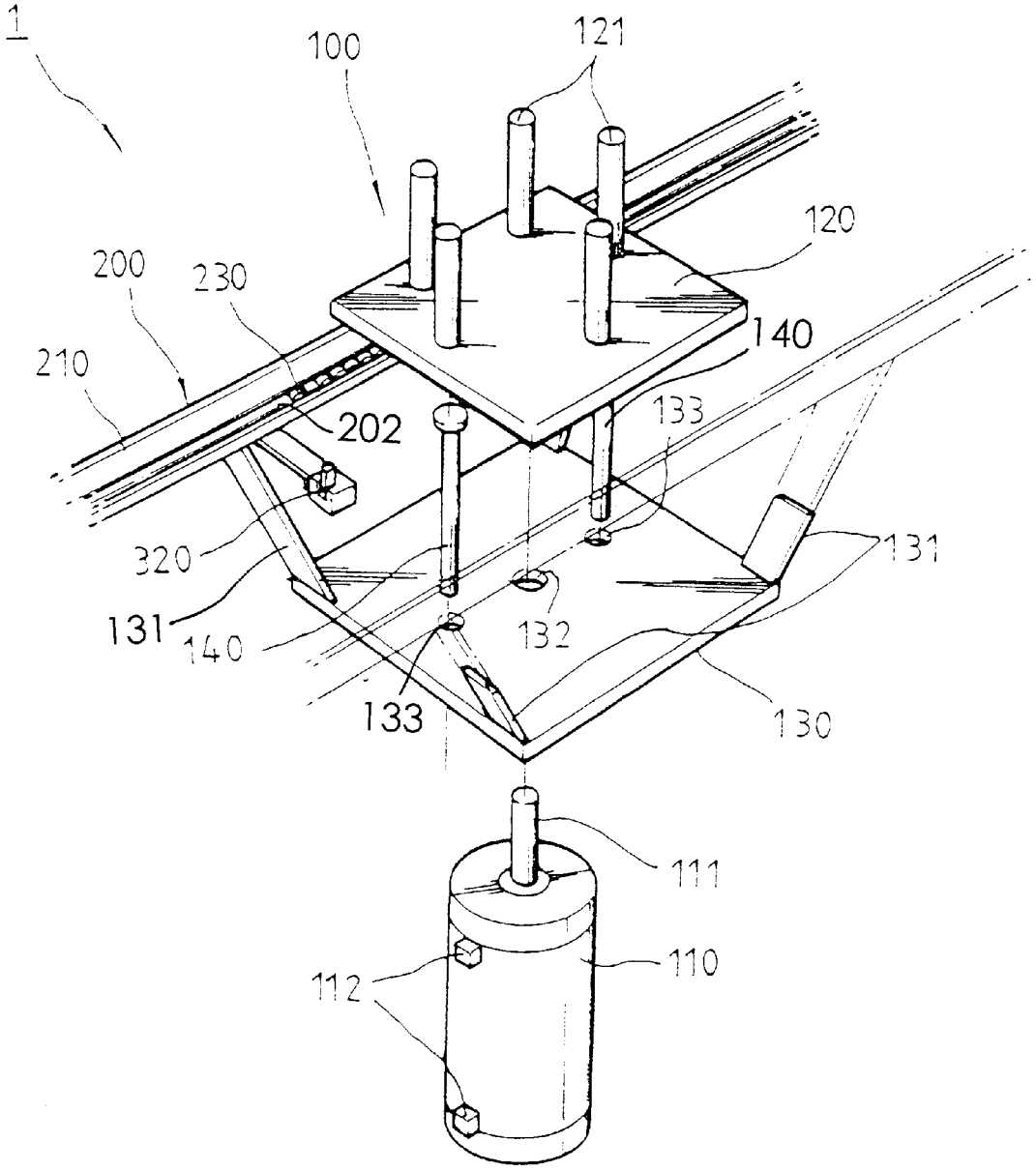
FIG. 1 is an exploded perspective view of a packing apparatus according to the present invention.
Figure 2:
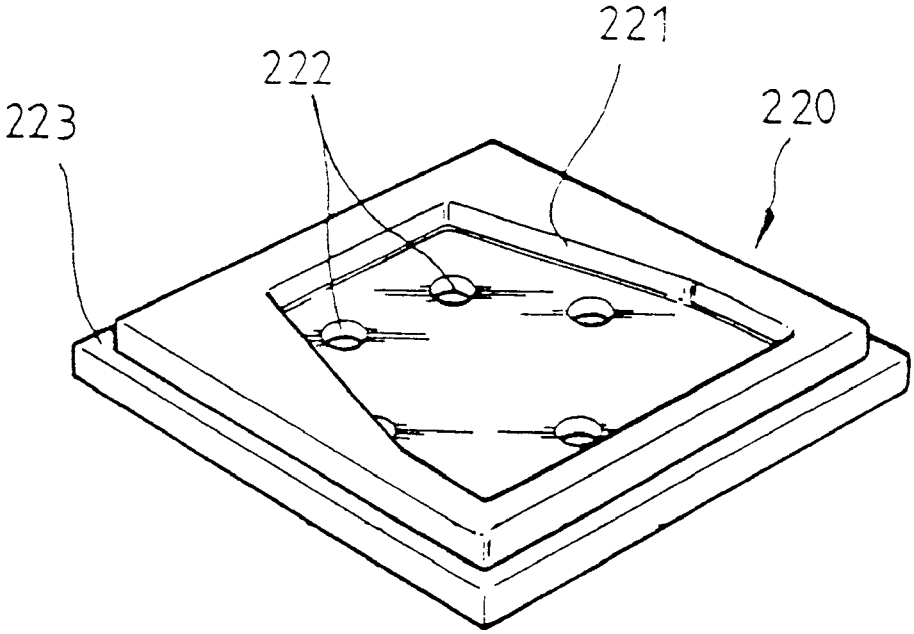
FIG. 2 is a perspective view of a pallet according to the present invention.
Figure 3:
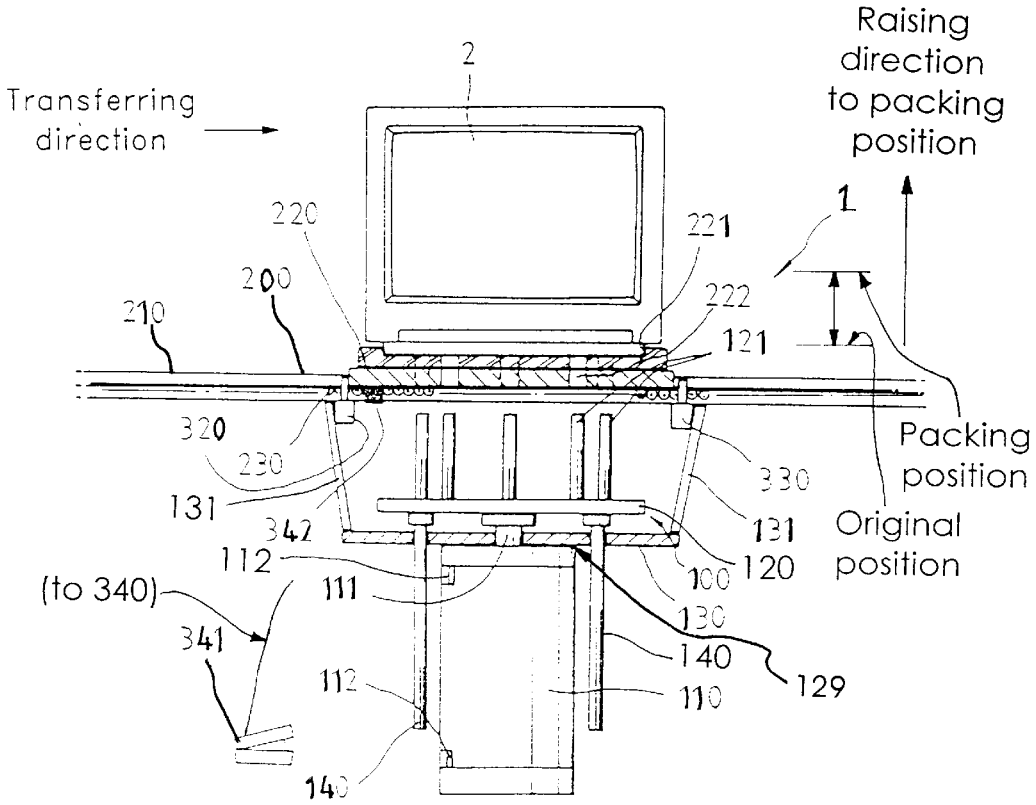
FIG. 3 is a cross sectional view of the present invention when a product, such as a monitor, to be packed arrives at the working position.

Referring to FIGS. 1 through 3, the packing apparatus 1 according to the present invention includes a transferring unit 200, such as a conveyor system, for transferring a product, such as a monitor 2, loaded on a pallet 220 at a predetermined position on the conveyor system; and an elevating unit 100 installed under the transferring unit 200 in spaced apart relation from the transferring unit 200 by a predetermined distance, for moving up and down the transferred monitor 2 or product in relation to the transferring unit.

As aforementioned, a conveyor is used as the transferring unit 200. The conveyor 200 includes conveyor frames 210 which are installed in parallel relation to each other; a pallet 220 which is moved along the conveyor frames 210 onto which the product, such as the monitor 2, is loaded thereon; and a plurality of moving rollers 230 which are rotatably installed in the conveyor frames 210 in the lengthwise direction of the conveyor frames 210. The moving rollers 230 can protrude out of the upper surface 202 of the base of the conveyor frames 210 to a predetermined height as illustrated in FIG. 1, for example, so that the pallet 220 can be rotatably conveyed in the fabricating line.

Referring to FIG. 2, the pallet 220 includes a body or base portion 223 and a recessed portion 221 corresponding to the bottom of the product to be packed, such as the monitor 2. A plurality of insertion holes or openings 222 are formed in or within the recessed portion 221. Referring to FIGS. 1 and 3, the elevating unit 100 includes a cylinder 110, such as a pneumatic or hydraulic cylinder, piston or solenoid, that serves as an elevating power source; an elevating member 120 which is coupled with a cylinder rod 111 of the cylinder 11 1 and moved up and down in association with the up and down movements of the cylinder rod 114; a plurality of supporting bars 121 which are installed on the upper surface of the elevating member 120 and moved through the insertion holes 222 of the pallet 220 when the elevating member 120 is moved in an upward direction so that the product, such as the monitor 2, can be moved in an upward direction in relation to the transferring unit 200; and a cylinder support 130 which includes a plurality of fixing bars 131 fixed or movably fixed to the conveyor frames 210 to move the elevating member 120 so as to be located under the pallet 220, the cylinder support 130 being installed between the elevating member 120 and the cylinder 110. The cylinder 110 is supported in association with the cylinder support 130. As one example, as illustrated in FIG. 3, cylinder 110 is fixed under the cylinder support 130 at a location 129, such as by welding, bolting, clamping or adhesively securing or the like.

In addition, the elevating unit 100 includes at least one guide bar 140 which is installed on the bottom of the elevating member 120 through the cylinder support 130 and guides the up and down movements of the elevating member 120 so that the cylinder 110 can move the elevating member 120 in the up and down directions more stably.

The number of the supporting bars 121 is not limited and can vary dependent upon the product to be packed. However, as the number of the supporting bars 121 is reduced, a larger area of the bottom of the product, such as the monitor 2, should be supported by one of the supporting bars 121 and the area of the insertion hole 222 formed in the pallet 220 should also be correspondingly enlarged. The embodiment shown in FIG. 1 has five supporting bars 121, for example.

The supporting bars 121 may be formed integrally with the elevating member 120. However, it can be desirable, for convenience in fabricating, to form the supporting bars 121 and the elevating member 120, separately, and then mount an end of a respective one of the supporting bars 121 on the elevating member 120.

The cylinder support 130 includes a through hole 132 for slidable insertion of the cylinder rod 111, and at least one guide hole 133 for slidable insertion of corresponding guide bar 140. The through hole 132 and the guide hole 133 correspond to a corresponding cylinder rod 111 and a guide bar 140, respectively.

As to each fixing bar 131, one end of a respective one of the fixing bars 131 is supported by the conveyor frame 210 and the other end thereof is supported by a comer portion of the cylinder support 130. The fixing bar 131 can be formed integrally with or attached to the cylinder support 130.

Figure 4:
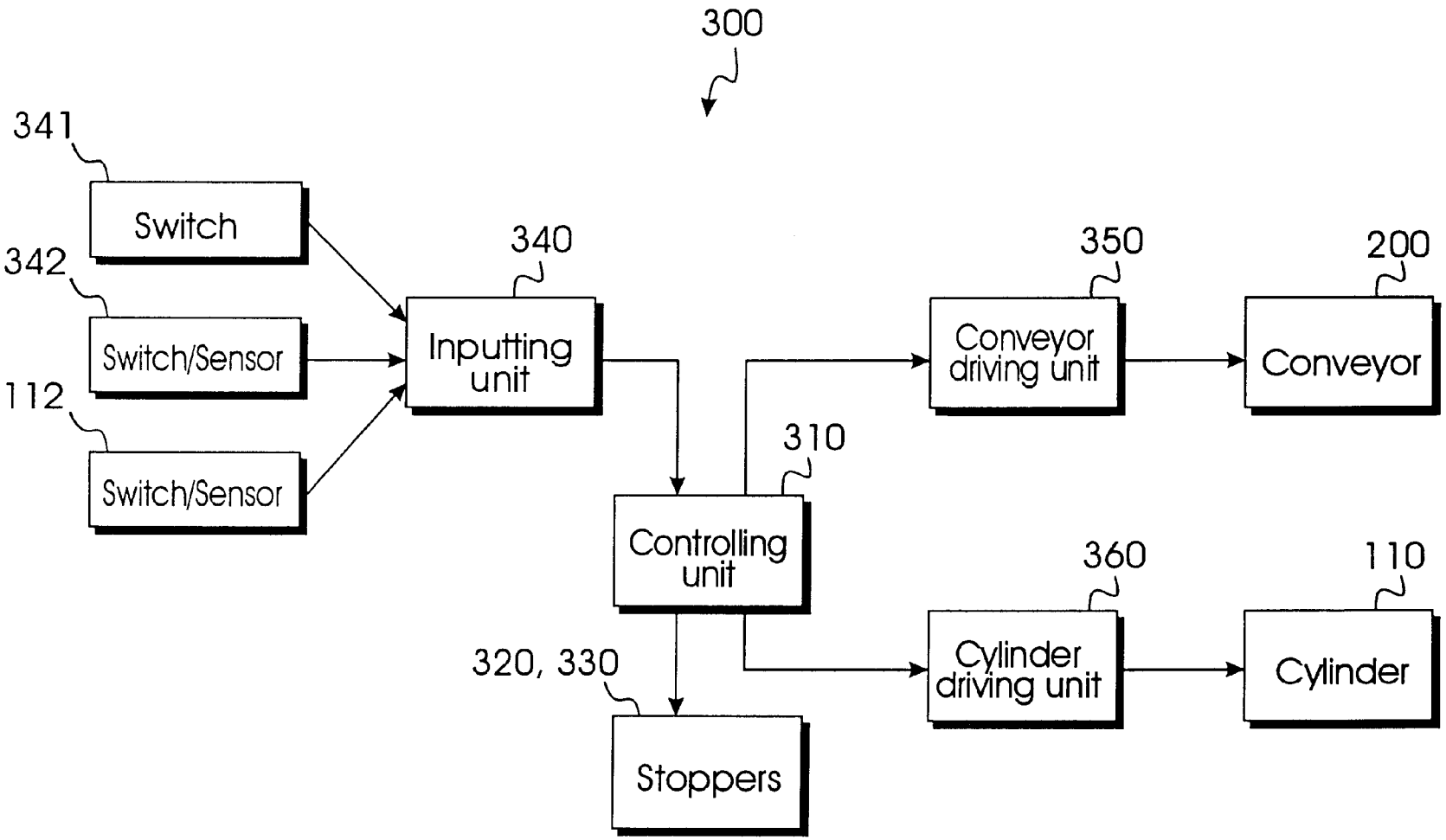
FIG. 4 is a block diagram of a controller of the present invention.

Referring to FIG. 4, a block diagram of a controller 300 for controlling the packing apparatus according to the present invention is illustrated. As shown in FIG. 4, the controller 300 includes an inputting unit 340 for inputting results from determinations as to whether the pallet 220 with the product, such as monitor 2, loaded thereon arrives at the working position or not, as to whether the cylinder 110 moves the elevating member 120 to a predetermined height to raise the product to the position, or not, and as to whether product, such as the monitor 2, is completely packed or not; a controlling unit 310 for receiving signals from the inputting unit 340 and controlling respective units according to the signals from the inputting unit 340; a conveyor driving unit 350 for receiving signals from the controlling unit 310 and driving the conveyor 200; and cylinder driving unit 360 for receiving signals from the controlling unit 310 and driving the elevating unit 100, including cylinder 110. The controlling unit 310 can be a computer, a central processing unit (CPU) or a microprocessor, for example.

Referring again to FIGS. 1 and 3, the inputting unit 340 includes: a pallet sensing unit 342, preferably mounted on one of the conveyor frames 210, which is turned on generating a signal to be conveyed to the controlling unit 310 when it senses the pallet 220 moved along the conveyor frames 210; an elevating amount sensing unit 112 installed on the upper portion and the bottom portion of the cylinder 110, for sensing a top dead point and a bottom dead point of the cylinder rod 111 and generating an appropriate signal to be conveyed to the controlling unit 310; and a work completion switch 341 for inputting a signal to be conveyed to the controlling unit 310 to indicate the completion of the packing job when the product, such as the monitor 2, is completely packed.

The pallet sensing unit 342 is preferably rearwardly located with respect to a front stopper 320, the front stopper preferably mounted on at least one of the conveyor frames 210. The front stopper 320 can be a limit switch that is turned on when it is brought in contact with the pallet 220, such as illustrated in FIG. 3. The elevating amount sensing unit 112 can be a position sensor or switch and the work completion switch 341 can be a foot switch for convenience of the work operator, for example.

The pallet sensing unit 342 can also be a sensor or a limit switch, for example. The limit switch or sensor of the pallet sensing unit 342 is installed in the conveyor frame 210 in such a manner that the limit switch or sensor does not prevent movement of the pallet 220 when the packing job is completed.

Figure 5:
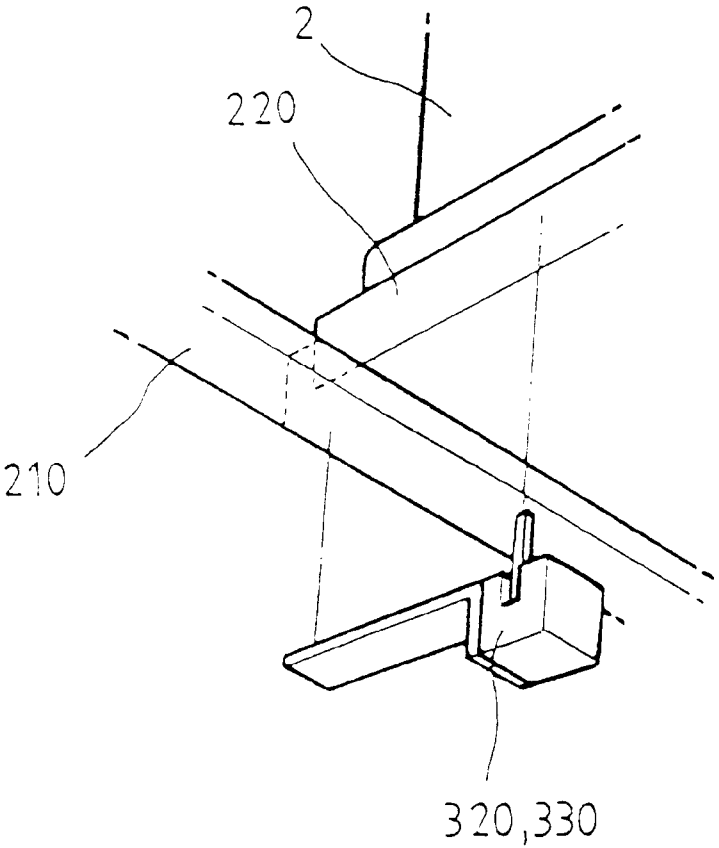
FIG. 5 is an exploded perspective view of a stopper according to the present invention.

The stoppers 320 and 330 of the packing apparatus of the present invention as shown in FIGS. 1 and 5, are preferably installed at the working position of the conveyor system. As shown in FIGS. 1 and 5, a rear stopper 330 is installed at a rear portion of the working position on at least one of the conveyor frames 210, for receiving a signal from the controlling unit 310 and fixing the pallet 220 at the working position; and the front stopper 320 is installed at a front portion of the working position on the conveyor frame 210, for receiving a signal from the controlling unit 310 and stopping another pallet following the pallet 220.

Figure 6:
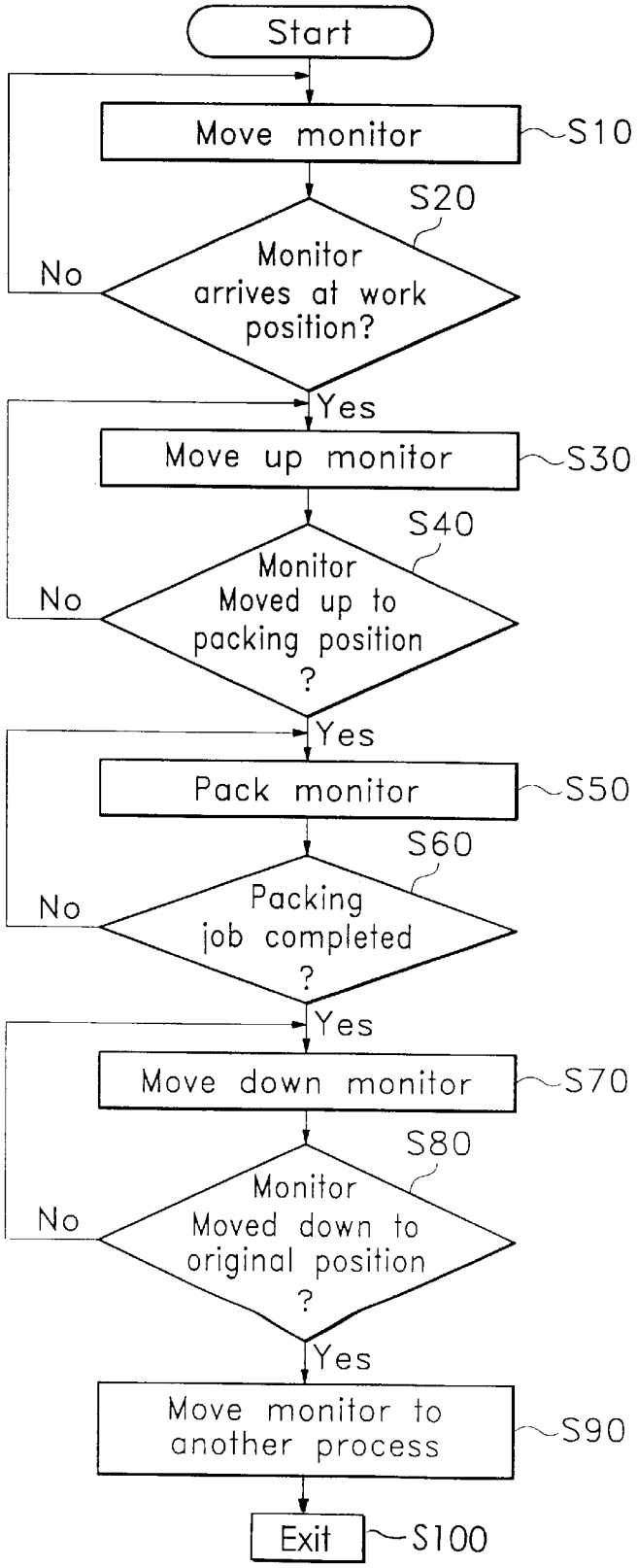
FIG. 6 is a flowchart of the packing operation of the present invention.

The operation the present invention will be described in detail with reference to the drawings with the respective components thereof being described by means of examples. Referring to the flowchart of FIG. 6, the packing operation of the present invention will be explained.

In step S10, the product to be packed, such as the monitor 2, is loaded on the pallet 220 on the conveyor frame 210 and moved in the direction as indicated by the arrow of FIG. 3.

In step S20, it is determined if the product, such as monitor 2, has arrived at the working or work position. The front and rear stoppers 320 and 330 are initially in their down states. When the pallet 220 is introduced and brought into contact with the limit switch 342, the limit switch 342 outputs a signal for indicating complete introduction of the product, such as monitor 2, and transmits the signal to the controlling unit 310 indicating the monitor 2 or product has arrived at the working position. The controlling unit 310 reads the signal from the limit switch 342 and moves the rear stopper 330 up so that the pallet 220 can not further presently proceed in the transferring direction of the conveyor system. In addition, when the pallet 220 is accurately located at the working position, the front stopper 320 is moved up so that the following pallet cannot be introduced to the working position. When the controlling unit 310 receives the signal from the limit switch 342, the controlling unit 310 also controls the conveyor driving unit 350 and the cylinder driving unit 360 to stop the operation of the conveyor unit, i.e., the conveyor 200 and to operate the cylinder 110, respectively. If in step S20 it is determined the monitor 2 or product has not arrived at the working position, control proceeds back to step S10 through the controlling unit 310.

If the monitor 2 or product has arrived at the working position, in step S30 the monitor 2 or product is moved up to the packing position. In step S30, when the cylinder 110 is operated, the cylinder rod 111 moves up the elevating member 120. When the elevating member 120 is moved up, the supporting bars 121 fixed to the elevating member 120 by their ends pass through the insertion holes 222 of the pallet 220 engaging the monitor 2 or product. As a result, the monitor 2 or product is moved up or raised in relation to the conveyor system from the original position to the packing position.

In step S40, it is determined if the monitor 2 or product has moved up or been raised to the packing position. During the upward movement of the monitor 2 or product in the raising direction, the elevating amount sensing unit 112 senses the amount that the cylinder rod 111 is extended to thereby determine whether the monitor 2 or product is moved up to a desirable position, i.e., the packing position, or not. If it is sensed that the monitor 2 or product is moved up to the packing position, the elevating amount sensing unit 112 outputs a signal for indicating the fact that the monitor 2 or product is moved up to the packing position and transmits the signal to the controlling unit 310. Then, the controlling unit 310 determines whether the monitor 2 or product is moved up to the packing position or not according to the signal transmitted from the elevating amount sensing unit 112. If it is determined that the monitor 2 or product is moved up to the desirable packing position, the controlling unit 310 controls the cylinder driving unit 360 to stop the operation of the cylinder 110. If the controlling unit 310 has not received a signal from the elevating amount sensing unit 112 indicating that the monitor 2 or product has been raised to the packing position, control remains or is returned to step S30 to continue to raise the monitor 2 or product until it has reached the packing position.

If is determined the monitor 2 or product has moved up or been raised to the packing position, control then proceeds to S50 to pack the monitor 2 or product. For example, in step S50, the monitor 2 is covered with a vinyl cover and buffering materials such as Styrofoam, and a hardened sponge or the like are mounted on the corner portions of the vinyl-covered monitor 2 by the operator. The monitor 2 with the vinyl cover and the buffering materials can then be packed with a box by the operator.

At the step S60, it is determined if the packing state or packing step is completed. If so, the foot switch 341 is turned on by the operator so that the foot switch 341 outputs a signal for indicting that the packing job is completed and transmits the signal to the controlling unit 310. If the packing state or step is not completed, control remains or is returned to step S50. If the packing step or state is completed, control proceeds to step S70.

In step S70, when the controlling unit 310 receives the signal from the foot switch 341, the controlling unit 310 controls the cylinder driving unit 360 to operate the cylinder 110 to move the elevating member down, thereby moving the monitor 2 or product toward the original position.

In step S80, it is determined if the monitor 2 or product has been moved down or returned to the original position. During the down movements in step S70, the elevating amount sensing unit 112 senses the amount that the cylinder rod 111 is returned. In the case that the monitor 2 or product is loaded on or returned to the pallet 220, the elevating amount sensing unit 112 outputs a signal for indicating that the monitor 2 is completely moved down to the original position and transmits such signal to the controlling unit 310. The controlling unit 310 reads the signal transmitted from the elevating amount sensing unit 112 and determines whether the monitor 2 or product is loaded on the desirable pallet 220 or not. If it is determined that the monitor 2 or product is loaded on the desirable pallet 220, the controlling unit 310 controls the cylinder driving unit 360 to stop the operation of the cylinder 110. Otherwise, control remains or is returned to step S70 to move the monitor 2 or product down to the original position.

If the monitor 2 or product has been returned to the original position, the process proceeds to step S90, whereby the monitor 2 or product is moved to another process or step in the fabricating or process line or to its termination point on the fabricating or process line. In step S90, the controlling unit 310 moves down the front and rear stoppers 320, 330 simultaneously. Thereafter, the conveyor driving unit 350 is controlled to operate the conveyor 200. As a result, the pallet on which the monitor 2 or product has been returned having the packing job completed is transferred to the following or another process step in the fabricating or process line. The process is then exited at step S100.

Thereafter, a following pallet 220 can be introduced to the working position and then moved to another process or step in the fabricating or process line by again performing the above steps S10 through S100 with a monitor 2 or product loaded on the following pallet 220.

The transferring unit may be a separate apparatus that is not installed on the conveyor, for example, a forklift truck, an automatic guided vehicle, or a crane used in the work area, for example. The elevating power generating member that is described by means of an example of a cylinder in the above embodiment, can also be a solenoid, for example.

As aforementioned, according to the present invention, an elevating unit capable of elevating a product to be packed is installed on the packing process line so that the process line and the elevating unit can serve as a packing apparatus. Therefore, an advantage of the process and apparatus of the present invention is that it is possible one operator can pack products on the fabricating or process line alone, even when the product is large. This also advantageously results in reduced cost and provides convenience and efficiency in packing the products.

This invention has been described above with reference to the aforementioned embodiments. It is evident, however, that many alternatives, modifications and variations will be apparent to those having skill in the art in light of the foregoing description. Accordingly, the present invention embraces all such alternatives, modifications and variations as fall within the spirit and scope of the appended claims.

What is claimed is:

1. An apparatus for packing a product, comprising:

transferring means for loading said product thereon and transferring said product to a working position, said transferring means including a pallet for receiving said product, said pallet including at least one insertion hole within a portion of said pallet that receives said product;

elevating means for raising said product transferred by said transferring means from an original position on said pallet to a packing position for packing said product and lowering said product from said packing position to said original position upon completion of packing said product, said elevating means including at least one supporting bar for insertion in a corresponding said insertion hole in said pallet, each said supporting bar engaging said product during raising and lowering of said product by said elevating means; and controlling means for controlling operation of said transferring means and said elevating means.

2. The apparatus according to claim 1, wherein said product is a monitor.

3. The apparatus according to claim 1, wherein said transferring means comprises:

at least one pair of conveyor frames which are installed in parallel relation to each other; and a plurality of moving rollers which are rotatably installed in said at least one pair of conveyor frames in a lengthwise direction of said at least one pair of conveyor frames and protrude to a predetermined height beyond an upper surface of a base portion of said at least one pair of conveyor frames for transferring said pallet by said plurality of moving rollers and any said product on said pallet.

4. The apparatus according to claim 3, wherein said elevating means comprises:

an elevating power generating member;

fixing means for fixing said elevating power generating member to said at least one pair of conveyor frames; and supporting means for supporting, raising and lowering said product by elevating power generated from said elevating power generating member.

5. The apparatus according to claim 4, wherein said elevating power generating member includes a solenoid.

6. The apparatus according to claim 4, wherein said elevating power generating member is a cylinder capable of producing elevating power, said fixing means includes:

a cylinder supporting member including a through hole for slidable insertion of a cylinder rod of said cylinder, said cylinder being supported in association with said cylinder supporting member; and a plurality of fixing bars, each of said plurality of fixing bars including an end fixed to said cylinder supporting member and the other end fixed to a respective one of said pair of conveyor frames, and said supporting means includes:

an elevating member including a bottom surface to which an end of said cylinder rod is fixed; and a plurality of supporting bars, each of said plurality of supporting bars including an end fixed to an upper surface of said elevating member so that said plurality of supporting bars can be brought in contact with said product when said product is to be raised and lowered from said pallet.

7. The apparatus according to claim 6, wherein said pallet includes:

a base portion;

a recessed portion on the base portion for receiving said product; and a plurality of insertion holes through said base portion within said recessed portion for slidable insertion of said supporting bars.

8. The apparatus according to claim 6, wherein said supporting means further includes at least one guide bar including an end fixed to the bottom surface of said elevating member for guiding up and down movements of said elevating member, and said cylinder supporting member includes at least one guide hole for slidable insertion of a corresponding said at least one guide bar.

9. The apparatus according to claim 6, wherein said controlling means includes:

a first inputting unit for inputting a result from a determination as to whether said product is at said working position;

a second inputting unit for inputting a result from a determination as to whether said product is raised to said packing position, and whether said product is lowered to said original position;

a third inputting unit for inputting a result from a determination as to whether said product at the packing position is packed; and a controlling unit into which signals from said first, second and third inputting units are input.

10. The apparatus according to claim 9, wherein said first inputting unit includes a limit switch installed on at least one of said pair of conveyor frames, for sensing an introduction of said pallet at said working position and generating a signal for inputting to said controlling unit according to whether said pallet is sensed as being at said working position.

11. The apparatus according to claim 9, wherein said second inputting unit includes at least one pair of position sensors respectively installed on an upper portion and a lower portion of said cylinder, for sensing a top dead point and a bottom dead point of said cylinder rod and generating a signal for inputting to said controlling unit according to whether said cylinder rod is sensed as being at one of said top dead point and said bottom dead point.

12. The apparatus according to claim 9, wherein said third inputting unit includes a foot switch which is operated by an operator for inputting a signal to said controlling unit when said product is packed.

13. The apparatus according to claim 9, wherein said first inputting unit includes a limit switch installed on at least one of said pair of conveyor frames, for sensing an introduction of said pallet at said working position and generating a signal for inputting to said controlling unit according to whether said pallet is sensed as being at said working position, said second inputting unit includes at least one pair of position sensors respectively installed on an upper portion and a lower portion of said cylinder, for sensing a top dead point and a bottom dead point of said cylinder rod and generating a signal for inputting to said controlling unit according to whether said cylinder rod is sensed as being at one of said top dead point and said bottom dead point, and said third inputting unit includes a foot switch which is operated by an operator for inputting a signal to said controlling unit when said product is packed.

14. The apparatus according to claim 9, wherein said controlling means further includes:

a conveyor driving unit for receiving a signal from said controlling unit and driving said moving rollers according to said signal from said controlling unit;

a cylinder driving unit for receiving a signal from said controlling unit and driving said cylinder according to said signal from said controlling unit; and front and rear stoppers for stopping and releasing said pallet at said working position operated according to a signal from said controlling unit.

15. The apparatus according to claim 14, wherein said first inputting unit includes a limit switch installed on at least one of said pair of conveyor frames, for sensing an introduction of said pallet at said working position and generating a signal for inputting to said controlling unit according to whether said pallet is sensed as being at said working position.

16. The apparatus according to claim 14, wherein said second inputting unit includes at least one pair of position sensors respectively installed on an upper portion and a lower portion of said cylinder, for sensing a top dead point and a bottom dead point of said cylinder rod and generating a signal for inputting to said controlling unit according to whether said cylinder rod is sensed as being at one of said top dead point and said bottom dead point.

17. The apparatus according to claim 14, wherein said third inputting unit includes a foot switch which is operated by an operator for inputting a signal to said controlling unit when said product is packed.

18. The apparatus according to claim 14, wherein said first inputting unit includes a limit switch installed on at least one of said pair of conveyor frames, for sensing an introduction of said pallet at said working position and generating a signal for inputting to said controlling unit according to whether said pallet is sensed as being at said working position, said second inputting unit includes at least one pair of position sensors respectively installed on an upper portion and a lower portion of said cylinder, for sensing a top dead point and bottom dead point of said cylinder rod and generating a signal for inputting to said controlling unit according to whether said cylinder rod is sensed as being at one of said top dead point and said bottom dead point, and said third inputting unit includes a foot switch which is operated by an operator for inputting a signal to said controlling unit when said product is packed.

19. A pallet for use in an apparatus for packing a product, comprising:

a base portion;

a recessed portion on said base portion for receiving said product to be packed; and at least one insertion hole through said base portion within said recessed portion for slidable insertion of a corresponding at least one supporting bar for engaging said product to be packed during raising and lowering of said product respectively to and from an original position on said pallet and a packing position above said pallet at a working position of said apparatus.

20. A method for controlling an apparatus for packing a product, wherein the apparatus comprises:

a transferring unit for loading said product thereon and transferring said product to a working position, said transferring unit including a pallet for receiving said product, said pallet including at least one insertion hole within a portion of the pallet that receives said product;

an elevating unit for raising said product transferred by said transferring unit to a packing position and lowing said product from said packing position to an original position, said elevating unit including at least one supporting bar for insertion in a corresponding said insertion hole in said pallet; and a controlling unit for controlling operation of said transferring unit and said elevating unit, said method comprising the steps of:

transferring said product on said pallet by said transferring unit to said working position;

determining whether said product has arrived at said working position;

stopping said product at said working position;

raising, using said elevating unit at said working position, the product up a predetermined height to said packing position by engaging said product with said at least one supporting bar though said at least one insertion hole in said pallet;

packing said product at said packing position to provide a packed product;

lowering, using said elevating unit, said packed product to said original position on said pallet; and transferring said packed product by said transferring unit to a subsequent process for said packed product.

* * * * *